United States Patent [19]

Parente et al.

[11] Patent Number: 4,995,609

[45] Date of Patent: Feb. 26, 1991

[54] IRON GOLF CLUB HEADS

[75] Inventors: Richard E. Parente, Solana Beach; Richard De La Cruz, Pauma Valley; Richard C. Helmstetter, Carlsbad, all of Calif.

[73] Assignee: Callaway Golf Company, Carlsbad, Calif.

[21] Appl. No.: 204,704

[22] Filed: Apr. 10, 1989

Related U.S. Application Data

[63] Continuation-in-part of Ser. No. 65,307, Jun. 23, 1987, which is a continuation-in-part of Ser. No. 19,702, Feb. 27, 1987, abandoned.

[51] Int. Cl.[5] ..... A63B 53/02

[52] U.S. Cl. ..... 273/80.2; 273/167 F; 273/169; 273/77 A

[58] Field of Search ..... 273/80.2–80.9, 273/167–175, 77 A; D21/220

[56] References Cited

U.S. PATENT DOCUMENTS

| | | | |
|---|---|---|---|
| D. 228,355 | 11/1973 | Penna | D21/220 |
| D. 234,963 | 4/1975 | Hirata | 273/167 FX |
| 1,585,294 | 5/1926 | Link | 273/80.8 |
| 1,590,469 | 6/1926 | Marsh | 273/80.8 |
| 1,600,389 | 11/1926 | Barrett | 273/80.8 |
| 1,690,266 | 11/1928 | Barrett | 273/80.8 |
| 1,792,852 | 2/1931 | Mattern | 273/80.8 |
| 2,203,893 | 6/1940 | Chapman | 273/167 K |
| 2,231,847 | 2/1941 | Dickson et al. | 273/80 C |
| 2,299,735 | 10/1942 | Birkhofer | 273/80.8 |
| 2,452,100 | 10/1948 | Campbell | 273/80.8 |
| 3,068,011 | 12/1962 | Sano | 273/169 X |
| 3,199,872 | 8/1965 | Taylor | 273/80.5 |
| 4,470,600 | 9/1984 | Parente et al. | 273/80 B |
| 4,632,400 | 12/1986 | Boone | 273/164 |
| 4,854,581 | 8/1989 | Long | 273/77 A |

FOREIGN PATENT DOCUMENTS

| | | | |
|---|---|---|---|
| WO8801525 | 3/1988 | European Pat. Off. | 273/167 F |
| 371974 | 5/1932 | United Kingdom | 273/80.2 |

OTHER PUBLICATIONS

"Perfect Pitch", *Golf Digest*, Jul. 1987, p. 29.
"T. P. Super Blade", *Golf World*, Jun. 13, 1972, p. 25.
"Some of our Best Friends are Hookers and Pushers", *Golf World*, Jan. 1974, p. 45.
"The Ounce That Counts", *Golf World*, Jan. 24, 1975, pp. 46, 47.
"Stroke Savers", *Golf Digest*, Mar. 1988, pp. 82–83.
"The Wilson Staff Dynapower Iron", As Seen in *Time Magazine*, Mar. 24, 1967, p. 1.
"FTD Iron By First Flight", As Seen in *Golf World*, May 23, 1972 p. 10.

*Primary Examiner*—Edward M. Coven
*Assistant Examiner*—Sebastiano Passaniti
*Attorney, Agent, or Firm*—William W. Haefliger

[57] ABSTRACT

An improvement in iron golf clubs in which an unusually short, hollow hosel is provided thereby reducing weight of hosel and bridge that can be redistributed to the blade to increase the momentum that can be imparted to a golf ball. The hosel is disposed at the heel end of the blade lapping the heel end from the upper edge of the heel end downwardly, there being no bridge between the blade and the hosel below the hosel, the hosel extending from a level above the top of the blade down to the sole, the hosel having a through bore of constant diameter extending from the top of the hosel down through the sole. The lower end of the hosel, in development view of the sole taken from below, extending at an obtuse angle forwardly from the heel end of the blade in the manner of a dog-leg. A shaft fixedly secured in the bore and extending completely to the sole. In a modified construction, the sole end of the hosel is squared with the longitudinal axis of the hosel forming a step in the sole below the hosel reducing weight of metal that also can be redistributed to the blade.

6 Claims, 7 Drawing Sheets

#1 IRON

2 IRON

3 IRON

#4 IRON

#5 IRON

#6 IRON

7 IRON

#8 IRON

9 IRON

PITCHING WEDGE

APPROACH WEDGE

SAND WEDGE

LOB WEDGE

IRON GOLF CLUB HEADS

BACKGROUND AND OBJECTIVES

Our invention concerns a new iron golf club which eliminates a bridge between blade and hosel of the head and juxtaposes blade and head thereby redistributing weight in the golf club head to increase mass available for momentum transfer to a golf ball. The hosel has a constant diameter through passage to the sole of the golf club head in which the club shaft is secured. In a developmental view of the sole of each club head, or in bottom view of each club head, the lower end of the hosel extending at an obtuse angle rearwardly from the heel end of the blade in the manner of a dog-leg. In a modified form of the invention, the sole end of the hosel is substantially squared relative to the longitudinal axis of the hosel forming a step in the sole, thereby reducing weight of metal of said hosel which is redistributed to the blade.

The iron golf club we have invented includes the following characteristics:

(1) An iron golf club head with a short, hollow hosel disposed at the heel end of the blade and formed from the same continuous piece of metal as an integral part completely lapping the heel end of the blade from top to bottom of the blade. There is substantially no bridge between blade and hosel and there is no bridge at all below the hosel. The hosel extends from a level above the top of the blade down to the sole of the club head. The hosel has a through passage or bore of constant diameter extending from the top of the hosel down through the sole. A golf club shaft is fixedly secured in the hosel and extends completely to the sole.

(2) An iron golf club head whose sole is wide enough at the heel to permit a three-eighths inch diameter hole to be drilled completely though the hosel and heel to accept full shaft penetration completely to the sole of the club head.

(3) An iron golf club head which provides for redistributing the mass from the portion of the hosel which has been eliminated by use of a short hosel and from the drilled hole and substantial elimination of a bridge between blade and hosel to that portion of the club head which contributes to the transfer of momentum to the golf ball. The golf clubs with the weight thus redistributed will have a minimum of fifteen percent more mass available for momentum transfer when compared to conventional iron golf clubs with the same loft. Note should be taken that when a bridge is substantially eliminated between blade and hosel, the weight otherwise devoted to the bridge is free to be relocated to a blade area.

(4) An iron golf club head with almost ideal toe to heel weight distribution so that it provides maximum torque resistance when golf ball contact is made at a point removed from the center of percussion, by having a greater lateral moment of inertia.

(5) An iron golf club with improved "feel" resulting from a concentration of the club head mass and from the fact that the shaft extends completely to the sole of the club head.

(6) An iron golf club head with a short hosel having a straight generally even diameter opening through to the club head sole and the club shaft extending completely to the sole of the club head and the parts of the head having such relationships that in a developmental view of the sole of the club head, or in a bottom view of the club head, the lower end of the hosel extends from the heel end of the blade at an obtuse angle forwardly from the heel end of the blade in the manner of a dog-leg.

(7) In a modified form of the invention, the sole end of the hosel is substantially squared relative to the longitudinal axis of the hosel forming a step in the sole, thereby reducing weight of the metal of the hosel which is distributed to the blade.

It is an objective of our invention to design club heads having the foregoing characteristics.

The purpose of these design features is to improve the performance characteristics of the iron golf club. Due to the concentration of the weight resulting from the transfer of mass from the hosel and bridge to the blade itself, the golfer will be more aware of the club head at all points during the swing. This should lead directly to improved consistency and effectiveness in returning the club head to the ball on the forward As a result of the foregoing features (other than the step) as much as approximately thirty seven grams (1.3 ounces) is free to be redistributed from the hosel and bridge to the blade. This can represent nearly twenty percent of the total club head weight for a 2-iron and over fifteen percent of the total club head weight for both the pitching wedge and the sand wedge. This improvement is accomplished without changing the overall weight of the golf club or of the club head (hosel plus striking blade).

All golf clubs are composed of three parts, the grip, the shaft, and the club head. Only the club head contributes to the actual flight of the ball. The shaft and the grip are important in that they assist the player in bringing the head of the golf club to the ball in an effective manner, much as the handle of the hammer or axe brings the working part of the tool to the work itself.

Our analysis of the iron club head reveals that the conventional club head is really composed of three parts, two of which are necessary:

(1) The blade, which is used to strike the golf ball.

(2) The hosel which provides the means for attaching the club head to the shaft. The hosel can be considered to be a necessary evil since other than holding the shaft it adds weight without contributing to that part of the club which imparts momentum to the golf ball. A more effective location for the hosel would be at a point near the center of percussion of the club head, a position which would result in the golf club being classified as "center-shafted". However, the rules of golf do not permit this configuration, except in the case of putters. For golf clubs, other than putters, the rules state, ". . . the shaft and the neck or socket must remain in line with the heel, or with a point to the left or right of the heel, when the club is viewed in the address position."

(3) A third part hitherto has been considered to be necessary in iron club heads, namely a bridge connecting the blade and the hosel. We have reached the conclusion that a bridge can be substantially eliminated in an iron club head, i.e., a short hosel can be formed directly at the end of the blade, the hosel socket can be formed as a constant diameter passage extending through the sole of the club head, and the shaft can be fixedly secured in that passage and extend completely to the sole. There is no bridge at all below the hosel whereas in the past in irons there always has been a bridge below the hosel. The hosel can be further shortened by squaring its lower end and by suitably redistributing to the blade this extra saved weight.

Conventional golf club iron heads have 20 to 25 percent of their weight in the hosel and the bridge. In order to compensate for this, manufacturers of irons shape the blade so that it is wider at the toe than at the heel. This helps to move the center of percussion (sweet spot) somewhat further from the hosel toward the center of the blade. For a golf club the center of percussion is that point on the club face at which the ball may be squarely struck without creating torque or a loss in momentum transfer. Some manufacturers carry this a step further and "toe-weight" the iron club head at the back. But even toe-weighted iron clubs may still have as much as 20 percent of the head weight in the hosel and bridge area.

It is an objective of our invention to reduce material in the hosel-bridge area of an iron golf club head and to redistribute the weight to the blade which contributes to the transfer of momentum to the golf ball.

More specifically, our design concept provides for removing about 1.3 ounces of material from within one-half inch of the heel of the iron club head on line with the axis of the shaft. Considering that the weight of the iron heads will vary from 8.5 ounces for a 2-iron to 10.5 ounces for a wedge, the material available for transfer, or redistribution, represents 15 to 20 percent of the total head weight and it is an objective of our invention to redistribute weight in the head in an amount of at least fifteen percent of the total head weight.

The "shaft-over-hosel" arrangement used by some manufacturers does not really save weight for redistribution to the striking area of the golf club, even though it may appear that way to the untrained eye. What appears to be a shorter and lighter hosel has a solid cylindrical section hidden inside and covered by the lower section of the shaft.

Golf clubs employing the conventional shaft/hosel arrangement have the shaft attached to only the upper one to one and one-half inches of the hosel which has been cast or bored to accept either a tapered or parallel tip of a shaft. This is a waste of material (as to the bridge between the hosel per se and the club blade) because, in addition to providing useless weight in that location, it adds aerodynamic drag near the point where the velocity is the greatest. Since parasitic drag of this nature is proportional to the square of the velocity, the effect is significant. It is an objective of our invention to reduce height and weight in the area of the hosel.

In our new design, the amount of hosel remaining on the golf club can be as low as about one inch long, which is enough for a satisfactory union with the shaft. More importantly, the part of the hosel and bridge that has been eliminated is that portion which was furthest from the center of the blade of the club head and has the most undesirable effect on the location of the center of percussion. This is readily apparent when one realizes that the standard lie angles for irons vary from 57 degrees to 64 degrees with an average of 60 degrees. This means that the hosel mass is tilted 30 degrees away from the toe of the iron golf club head. Yet another benefit derived from moving the center of percussion toward the toe is that the sweet spot is now located further from the hosel and this lessens the probability of experiencing the dreaded shanked golf shot where the ball is deflected sharply to the side as a result of inadvertently contacting the hosel.

Our invention will be best understood, together with additional advantages and objectives thereof, when read with reference to the drawings.

DRAWINGS

FIG. 1 is a front view of the head portion of a golf club forming a specific embodiment of our invention. Certain parts are broken away and shown in section to better illustrate the parts. The club illustrated is a #5 iron.

FIGS. 7 to 19 are, respectively, developmental views of #1, #2, #3, #4, #5, #6, #7, #8, and #9 irons, a pitching wedge (about 48° in loft), an approach wedge (about 52° in loft), a sand wedge (about 56° in loft), and a lob wedge (about 60° in loft).

Figure 1:
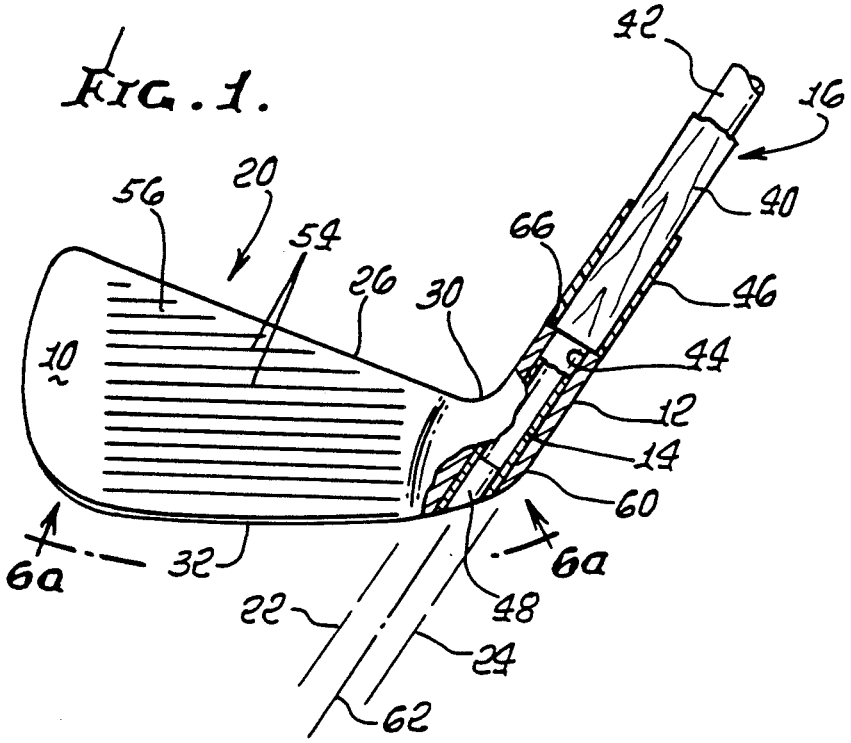
Figure 20:
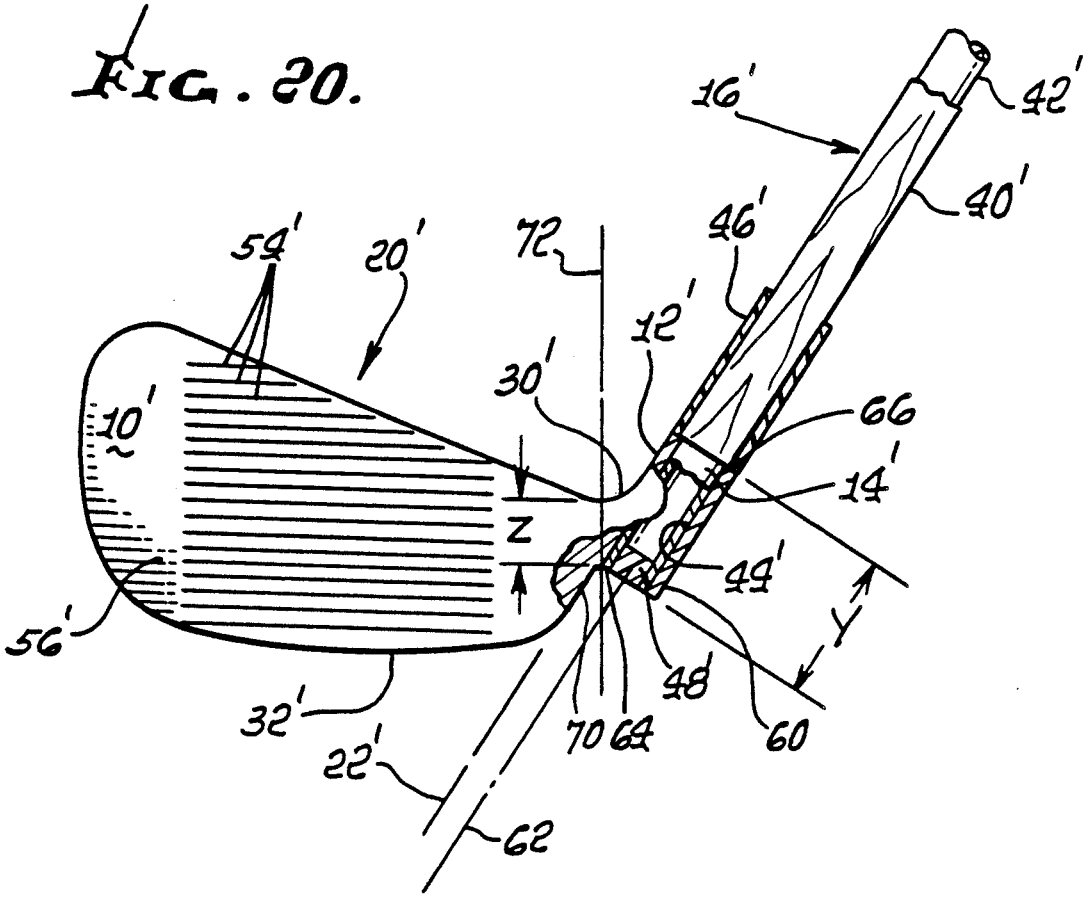

FIG. 20 is a front view similar to FIG. 1 but of a modified, stepped construction. The club illustrated is a #5 iron.

Figure 21:
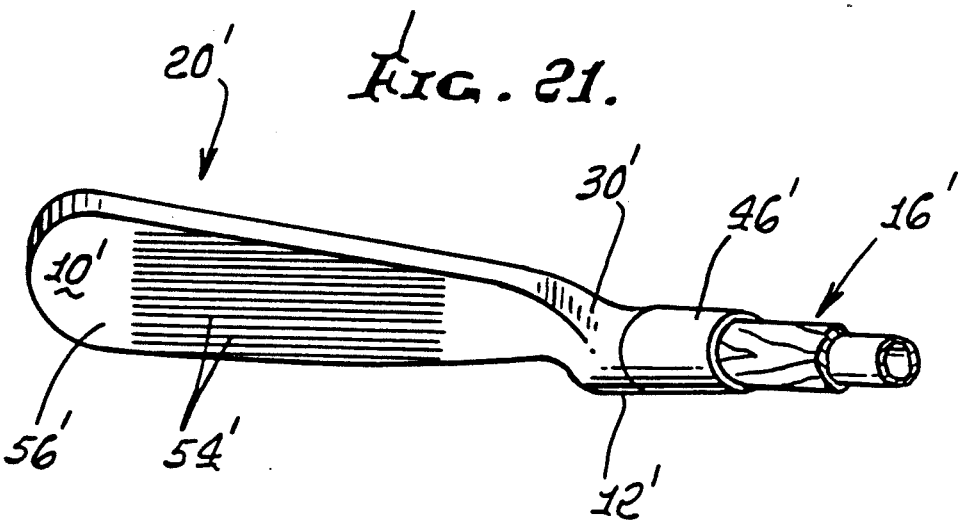

FIG. 21 is a top view.

Figure 22:
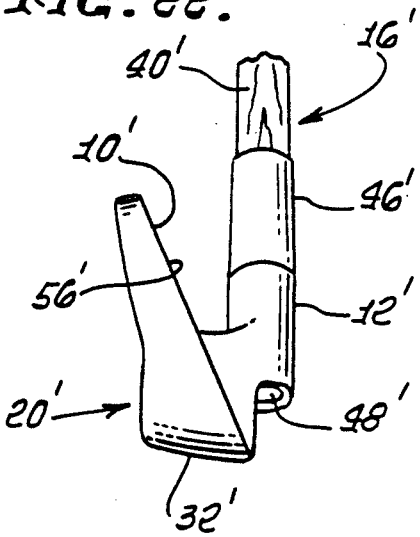

FIG. 22 is an elevational view from the toe end.

Figure 23:
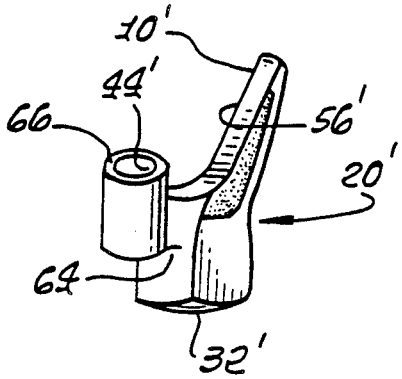

FIG. 23 is an elevational view from the heel end.

Figure 24:
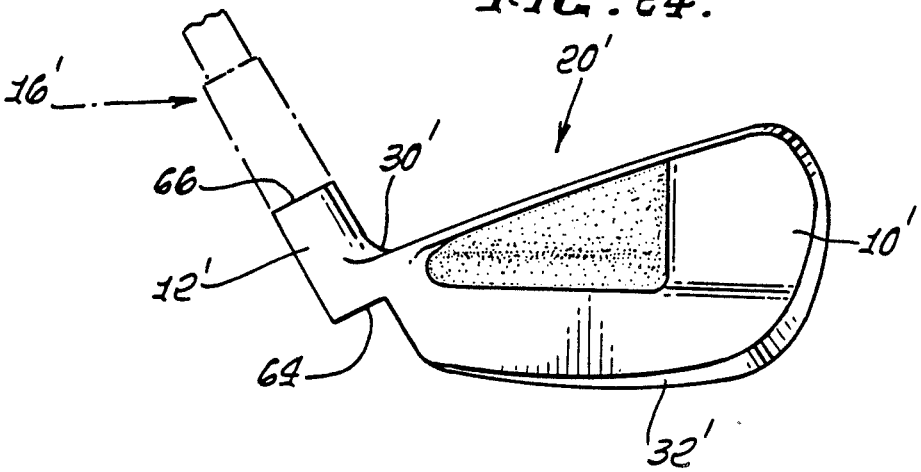

FIG. 24 is a rear view.

Figure 25:
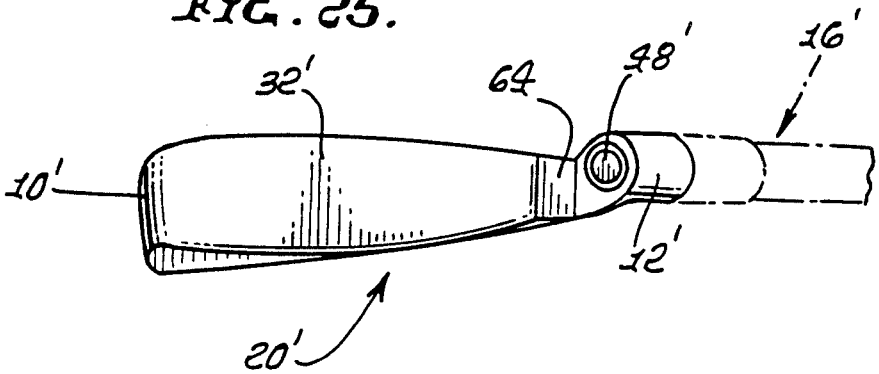

FIG. 25 is a bottom view.

SPECIFIC DESCRIPTION

When the expressions "iron golf clubs" and "iron golf club heads" are used in the specification and claims, they should be taken as having their usual meaning in classifying golf clubs and heads in golfing and shall cover in addition to iron clubs any use of other than iron metals in like club head manufacture. The expression "on golf club head" shall include all of those club heads illustrated in the drawings, namely the #1, #2, #3, #4, #5, #6, #7, #8, #9 irons, the pitching wedge, the approach wedge, the sand wedge, and the lob wedge.

The definition of "iron" also can be used from *Davies' Dictionary of Golfing Terms,* by Peter Davies (Copyright 1980-Simon & Schuster):

> "(d) 1930-present Any iron- or steel-headed club, now making up a numbered set of nine, having graduated lofts, lies, and lengths of shaft; the number one iron through the number nine iron (each having a vestigial name inherited from earlier times); the wedges and sometimes the putter being also counted as irons."

For the purposes of the present specification and claims, the putter is excluded from the definition of "irons" because the present invention is concerned with other than putters. As to materials, we want to cover such other materials that may be substituted for iron (in so-called "iron" clubs) such as graphite, steel, beryllium-copper, titanium, and other alloys.

From the same dictionary, the following definition of "blade" 10 is used for purposes of the specification and claims:

> "1 n. The hitting part of an iron clubhead, not including the hosel."

In the same dictionary, the "hosel" 12 is defined as follows:

"hosel n. & v. [Origin: Scottish hosel, hoozle, houzle='socket of a shafted iron tool.' Sc. N.D. derives it from the verb house='to fix in a socket or housing.' . . . 1 n. The socket or neck of an iron clubhead."

The "hosel" 12 will be further defined for purposes of the specification and claims as an annulus of some length, which comprises the physical structure surrounding, supporting and securing the portion 14 of the shaft 16 embedded in hosel 12. In FIG. 1, the annular hosel 12 can be seen in cross-section as surrounding, supporting and securing shaft portion 14 embedded in hosel 12. Hosel 12 is a socket but in the prior art the socket has a closed bottom whereas in our hose 12 the socket is open bottomed (which is one aspect of minimizing metal and thus weight in the hosel area of the club head 20). Considering the frontal view of FIG. 1, broken lines 22, 24 can be considered to be planes at the edges of hosel 12 in cross-section. If the line 26 of the top of blade 10 in frontal view is considered, it will be seen to almost directly contact hosel 12 and line 22 except a small amount of radiusing 30 may be given therebetween which is shaded in FIG. 1 and which will be termed to be a "bridge". It would be possible to construct the club head of FIG. 1 without bridge 30 but it is normal to provide such radiusing in this and some other metal manufacturing whether for appearance, for strength, or for ease of casting, milling, forging, etc. If the line 32 of the sole of blade 10 in frontal view is considered, it will be seen to directly contact hosel 12 and line 22 so there is no "bridge" inbetween. Upon analysis, any bridge larger than bridge 30 would serve no purpose. If another party should provide a larger bridge, that will still be considered for patent purposes as being "no substantial bridge" as it would be only serving some non-bridge purpose such as aesthetics.

The point that is being made is the substantial absence of a bridge 30 between blade 10 and hosel 12 in our new golf club heads 20. No bridge 30 is present under hosel 12. This is one of the unique contributions of our invention to the art of golf club irons.

In comparing between different types of iron golf clubs in the specification, comparisons are made on the basis of club face lofts because clubs with comparable lofts will usually have the same club head weights and overall club lengths. For example, conventional 5-irons with D-0 swing weight will normally be made up as follows:

| | |
|---|---|
| head-weight | 267 grams |
| shaft weight | 120 grams |
| grip weight | 53 grams |
| TOTAL WEIGHT | 440 grams (15-½ oz.) |
| loft angle | 30 degrees |
| club length | 37 inches |

Some club makers may vary the loft of the 5-iron by as much as 4 degrees. Since the loft angle has a major effect on the distance the golf ball will carry through the air, it is best to compare irons on the basis of loft rather than club number.

The type of shaft 16 shown has a hickory outer tube 40 and a steel or other non-wood inner tube 42 bonded together This type of shaft was described in our prior patent No. 4,470,600. Whether the shaft is made in this manner or is a plain steel or other non-wood shaft, the end portion 14 (the end of inner tube 42 in the construction illustrated) has a generally constant outer diameter snugly fitting in a passage or bore 44 in hosel 12 of preferably about three-eighths inch diameter. Shaft end portion 14 is bonded in place by an epoxy adhesive and also may be wedged. A plastic sleeve 46 may be used to cover the end portion of the hickory outer tube 40 abutting hosel 12. A cord whipping could be substituted for sleeve 46. The lower end of hosel 12 is ground to fair into the remainder of contour of the sole 32 of blade 10. A plastic plug 48 is bonded in the end of shaft portion 14 to seal the end of the shaft and the lower ends of shaft Portion 14 and plug 48 likewise can be ground to match the contour of sole 32.

In present manufacture, we are securing shaft portion 14 in bore 44 by bonding. It is also practical to secure shaft 14 in place by wedging in addition to bonding, i.e., to provide shaft 14 and/or bore 44 with a small degree of taper, i.e., 0.040" taper more or less and not apparent to the naked eye. When the term "constant diameter" is used in the specification and claims in connection with shaft 14 and/or bore 44, such nominal tapers of present day tapered iron shafts are not meant to be excluded, i.e., 0.040" give or take. Tapered iron shafts and parallel tip shafts are both meant to be included. What is meant to be excluded are some old Wilson "Dynapower" iron club heads in which there was a dual-diameter passage through the club head from top to sole having an upper normal hosel diameter passage serving the hosel function and having a lower, small, reduced-diameter passage to the sole with an elastomeric plug which gave the impression the shaft extended to the sole but really wasn't the case. Apparently, the lower passage and plug did not have a function other than appearance.

The preferred length of hosel bore 44 is about an inch. Any longer than one and a half inches maximum would serve no purpose, which is to adequately secure shaft 16, and, again, one inch is considered sufficient. This would be the length along the centerline 62 of bore 44 as viewed in face view. It will be seen that bore 44 is longer at its end toward the toe of the club head than toward the heel of the club head, whereas the length along axis 62 in face view may be considered the average length of bore 44.

The wedges have sufficient metal in the hosel area in a fore and aft direction to provide a constant diameter three-eights inch bore 44 and to provide sufficiently thick walls of at least one-sixteenth inch for a total minimum thickness of about one-half inch. However, clubs in present manufacture are increasingly thin fore and aft in the hosel area as they progress to Number Five, Number Four, Number Three, Number Two and Number One Irons. To obtain the necessary minimum fore and aft thickness of about one-half inch, it is necessary to maintain thickness of the club heads 20 in a fore and aft direction of at least one-half inch. When the expression "hosel" is used in this specification and the claims it is given the definition as including not only that part of the material encircling the shaft above the upper surface of the remainder of the club head but also the corresponding portion of the main part of the club head itself that encircles the shaft as it extends to the sole 32 of the club head 20. It was not necessary to think of part of the main part of the club head as serving a hosel function in prior art clubs in which all hosel functions terminated above the level of the top of the remainder of the club head.

The improvement is especially striking if the case of the 1-iron is considered. The head of a 1-iron weighs about 239 grams. The extra amount of material which is made available for momentum transfer by this new design is the same as for the wedge, 37 grams. The effective 1-iron blade mass for our design will be 219 grams versus 182 for the conventional 1-iron, a difference of 20.3 percent. Since the total weight will not have changed, both golf clubs can still be swung with the same club head speed and our 1/iron would have over 20 percent greater effective momentum (mass time velocity) prior to contact with the ball.

The following tabulation shows the difference in effective mass available for momentum transfer for a set of irons, conventional versus ours in the D-0 to D-2 swing weight range.

| | EFFECTIVE MASS AVAILABLE FOR MOMENTUM TRANSFER | | | | |
|---|---|---|---|---|---|
| CLUB | CLUB HEAD WEIGHT GRAMS | OUR EFFECTIVE MASS GRAMS | BLADE MASS CONVENTIONAL GRAMS | DIFFERENCE GRAMS | DIFFERENCE PERCENT |
| 1-Iron | 239 | 219 | 182 | 37 | 20.3 |
| 2-Iron | 246 | 226 | 189 | 37 | 19.6 |
| 3-Iron | 253 | 233 | 196 | 37 | 18.9 |
| 4-Iron | 260 | 240 | 203 | 37 | 18.3 |
| 5-Iron | 267 | 247 | 210 | 37 | 17.6 |
| 6-Iron | 274 | 254 | 217 | 37 | 17.1 |
| 7-Iron | 281 | 261 | 224 | 37 | 16.5 |
| 8-Iron | 288 | 268 | 231 | 37 | 16.0 |
| 9-Iron | 295 | 275 | 238 | 37 | 15.5 |
| Wedge | 302 | 282 | 245 | 37 | 15.1 |
| Sand Wedge | 302 | 282 | 245 | 37 | 15.1 |

Club heads 20 have through passages or bores 44 of constant diameters, i.e., three-eighths inch, to the soles 32 of the heads. Golf club shaft 16 has a portion of constant diameter 14 fitting snugly in the through passage 44 and bonded in place with an adhesive. Shaft 16 extends to sole 32 of club head 20. The hosel 12 includes a portion formed around the upper portion of passage 44 and includes a portion at the heel end of blade 10.

Club heads 20 have standard weights for club heads of the same loft. Because of change in weight distribution in the club heads, the mass available for momentum transfer to a golf ball during golf strokes is at least fifteen percent greater with our club heads than with conventional iron club heads of the same loft and club head weight without a constant diameter bore to the club head sole for installing a golf club shaft and with a normal length hosel having the upper portions of the hosel usually extending above the sole of the club head 20 a distance of at least two and a half inches (measured along the axis of the hosel). In prior art club heads, the bore of the hosel in which the shaft is secured extends only part way to sole of the club head.

The sole 32 of our club heads 20 are designed wide enough at the heels to permit through passages 44 to have about three-eighths inch diameters.

The face of the iron club head and the material directly behind the face are the only parts which contribute directly to transferring momentum from the club to the golf ball. Using the wedge as an example, the overall weight of this club is in the neighborhood of 472 grams or 16½ ounces. The components parts are as follows:

| | |
|---|---|
| head | 302 grams |
| shaft | 117 grams |
| grip | 53 grams |

-continued

| | |
|---|---|
| TOTAL | 472 grams |

The average length of the conventional wedge head along the axis of the hosel is approximately 2.5 inches. The arrangement for the conventional club head commonly has the shaft or shaft liner penetrating the hosel to a depth of 1.5 inches. Our bore or passage 44 which is drilled to receive the shaft 16 and now serves the function of the hosel is preferably 0.375 inches in diameter, and in the case of the wedge the length of 1.20 inches for passage 44 will be used for calculations. Considering that the removed section of the hosel has an average outside diameter of 0.53 inches and an inside diameter equal to 0.375 inches, the weight of this piece is about 18.8 grams. The weight of the material which formerly occupied the 0.375 hole which has been drilled to accept the shaft, has eliminated another 18.8 grams of metal from the hosel area. Between the two, a total of 37 grams (1.3 ounces) of metal has been made available for transfer to the ball striking section without increasing the overall weight of the head. It is important that the overall weight of the club head remain the same so that the club can be swung with the same velocity and that the swing weight be unchanged.

The following is a comparison of the head of a conventional wedge with this new short hollow hosel wedge of our invention:

| | OUR CLUB HEAD 20 | CONVENTIONAL CLUB HEAD |
|---|---|---|
| Total head weight | 302 grams | 302 grams |
| Upper hosel material | 0 grams | −19 grams |
| Metal remaining in shortened hosel | −20 grams | −20 grams |
| Metal left in through passage | 0 grams | −18 grams |
| Remaining head mass available for momentum transfer | 282 grams | 245 grams |
| Difference | 37 grams | |
| Percentage increase in effective mass | 37/241 × 100 = 15.1 percent | |

The improvement is striking if the case of the 2-iron is considered. The head of a 2-iron weighs about 246 grams. The extra amount of material which is made available for momentum transfer by this new design is the same as for the wedge, 37 grams. The effective 2-iron blade mass for our design will be 222 grams versus 155 for the conventional 2-iron, a difference of 20.0 percent. Since the total weight will not have changed, both golf clubs can still be swung with the same club head speed and our 2-iron would have over 20 percent greater effective momentum (mass times velocity) prior to contact with the ball.

In order to demonstrate the effect of moving the weight saved in the hosel area to the club face area, it is necessary to derive an equation for the distance (carry) that the golf ball will travel as a function of effective head weight, club head speed, club loft angle and the coefficient of restitution between the golf ball and the club face. Throughout the discussion and the derivations, the following symbols will be used.

M—effective mass of the club head (ounces)
m—mass of the golf ball (1.62 ounces)
$U_1$—club head velocity prior to impact
$U_2$—golf ball velocity prior to impact =0
$v_1$—club head velocity just after separation
$v_2$—golf ball velocity just after separation
e—coefficient of restitution between the ball and the club face The values of "e" are limited. The limits for values of "e" are zero and 1.0. "e" for a material such as soft clay or putty would be near zero, while for a perfectly elastic material, where no energy is lost as a result of deformation, the value of "e" would be 1.0.

$$e = -\frac{v_2 - v_1}{U_2 - U_1}$$

In making comparisons the exact values of e are not important. However, a realistic value is useful in order to appreciate the results obtained from such a comparison.

In the case of a golf club with little loft, such as a driver having a central impact with a stationary ball, the following data has been obtained from actual experiments.

$U_1$=100 miles per hour (mph)
$U_2$=0
$v_1$=69 mph
$v_2$=135 mph then $$e = -\frac{135 - 69}{0 - 100} = 0.66$$

This value of e will be used throughout this discussion. It is quite likely that the value of e may be slightly higher when more lofted clubs are used. This is due to the fact that since the impact for lofted clubs is not a directly central one, there will be less deformation. It is interesting to note that in the case of a putter, the very low club head speed results in little deformation of the ball. In this case, the value of e would be in the neighborhood of 0.80. Since the irons in a set of golf clubs will have lofts varying from 14 degrees for a 1-iron to 60 degrees for a lob wedge, the values of the coefficient of restitution would be different for each club/ball combination.

The velocity of the golf ball immediately upon separation from the impact with the golf club is the main factor in determining how far the golf ball will carry through the air. If the same type of golf ball is used, then the ball is eliminated as a variable. The initial golf ball velocity in a central impact situation is a function of the effective weight of the club head, the weight of the golf ball and the coefficient of restitution between the ball and the club face.

The derivation of the initial golf ball velocity is made possible by applying the Law of Conservation of Momentum to this situation. However, since the velocity of the club head after separation from the ball is not known, a second equation is necessary for the solution. This second equation requirement is met by substituting from the equation for e, the coefficient of restitution. This results in the following final equation for the initial golf ball velocity $v_2$.

$$v_2 = U_1 \frac{1 + e}{1 + (m/M)}$$

$v_2$ and $U_1$ must be expressed in the same units, as must m and M. Values of U are determined from actual tests employing commercially available devices or from high speed photography. The following tabulation shows the effect of e on initial golf ball velocity using a driver with an effective club head weight of 7 ounces, $U_1$ equal to 100 mph and a golf ball with the standard weight of 1.62 ounces.

$v_2 = 100\,(1 + e)/1.23 = 81.2\,(1 + e)$

| e | $v_2$ (mph) | e | $v_2$ (mph) |
|---|---|---|---|
| 0.0 (putty) | 81 | 0.7 | 138 |
| 0.5 | 122 | 0.8 | 146 |
| 0.6 | 133 | 0.9 | 154 |
| 0.66 | 135 | 1.0 | 162 |

It is interesting to note that for the perfectly elastic golf ball, the initial velocity could be no greater than 162 miles per hour for a club head speed of 100 miles per hour. For the actual condition where e =0.66, the initial velocity is 135 miles per hour. Even if the Rules of Golf did permit higher values of e, not much more could be accomplished because balls that are fabricated so as to have higher values of e would be brittle and tend to shatter upon impact.

When a golf ball leaves the face of the club, it becomes a free flying missile. The flight pattern of the ball is affected by a number of factors, among them are air density, the launch angle, the backspin imparted by the club which, in turn, produces lift, aerodynamic drag due to both lift (induced drag) and shape (parasite drag) and, finally, gravity. Both lift and drag (air resistance) vary with the square of the velocity and these are both constantly changing from maximum values as the ball leaves the club face at velocity, $v_2$, until the ball finally strikes the ground at a much lower velocity. The launch angle and backspin will vary from one golfer to another and even from shot to shot for the same golfer. Therefore, the determination of how far the golf ball will travel is generally based in empirical formulae derived from experimental values observed under certain atmospheric conditions (barometric pressure, temperature, wind velocity, terrain features) and ground condition if total distance including roll is also desired.

The following average values were determined and published in *GOLF DIGEST* for August, 1986, from test employing a driver with a head weight of approximately 7 ounces, standard golf balls weighing 1.62 ounces and having a diameter of 1.68 inches.

| $U_1$(mph) | Carry Average |
|---|---|
| 100 | 244 yards |
| 90 | 215 yards |
| 80 | 184 yards |

Using a value e=0.66, M=7 ounces, m=1.62 ounces, values of $v_2$ can be calculated and yield:

$$v_2 = U_1 \frac{1 + e}{1 + (m/M)} = 1.35\ U_1, \text{ then for}$$

| $U_1$ (mph) | $v_2$ (mph) | $v_2$ (fps) |
|---|---|---|
| 100 | 135 | 198 |
| 90 | 122 | 179 |
| 80 | 108 | 158 |

A graphical presentation of carry, in yards, versus initial golf ball velocity, in feet per second, would reveal a linear relationship. The linear equation which satisfies these average values is:

Average carry (in yards)=1.5 $v_2$−53 where $v_2$ is expressed in feet per second.

This equation can be used to predict the carry of the golf ball where the club face loft angle is quite small, that is, less than 20 degrees. For more lofted clubs, the velocity component normal to the club face should be used. This will be done in comparing lofted irons below.

The following calculations provide a quantitative performance analysis which compares our new short hosel irons with conventional irons. The assumption is made that a low handicap golfer can achieve a club head speed of 95 miles per hour with a 39 inch 1-iron and 85 miles per hour with a 37 inch 5-iron.

1-IRON COMPARISON loft—14 degrees (cos=0.970)

$U_1$=90 mph=139 fps.

$U_1$ (effective)=$U_e$=139×0.970=135 fps.

Effective head weight conventional club $M_1$=239—57=182 grams=6.42 oz.

our club $M_2$=239—20=219 grams=7.72 oz.

Use e=0.66

$v_1$—Initial golf ball velocity with conventional club $v_2$—Initial golf ball velocity with our club Using the previously derived equation for $v_2$ conventional club $v_1$=179 feet per second our club $v_2$=185 feet per second when these values are inserted in the equation for "carry"

conventional club carry=1.5×179−53=215 yards our club carry=1.5×185—53=224 yards The difference is 9 yards which amounts to 4.2 percent.

5-IRON COMPARISON loft—30 degrees (cos=0.866)

$U_1$ (effective)=$U_e$=125×0.866=108 feet per second

Effective head weight conventional club $M_1$=210 grams=7.41 oz.

our club $M_2$=247 grams=8.71 oz.

Following the same procedure as for the 1-iron:

conventional club $v_1$=147 feet per second; carry=167 yards our club $v_2$=151 feet per second; carry=174 yards Difference in carry is 7 yards or 4.2 percent.

It will be recognized that these results fall within the range of values that are experienced under actual conditions.

In the case of the sand wedge, distance is not such an important factor as with the fairway irons. However, in the sand wedge, the saved weights would be transferred to the sole of the club as additional flange materials. By so doing, the center of percussion is lowered and this will make it much easier to bring the ball up from the sand in the bunker. When the sand wedge is used as a fairway club, the trajectory will be somewhat higher, at the same time, achieving less run on reaching the green. This is of particular value on part wedge shots where not as much backspin can be imparted to the ball.

Our new golf club with a short drilled-through hosel 12 and with substantial elimination of a bridge 30 represents a revolutionary concept which dramatically improves the efficiency and the "head feel" of iron golf clubs. The weight saved from the area near the heel of the club is moved to the lower section of the iron nearer the toe.

As a result, a blow properly struck will result in an improved trajectory, including added distance amounting to 4 to 5 percent in the case of the fairway irons. The sand wedge will be more effective due to lowering the center of gravity, and, of course, the center of percussion. This will make the wedge more effective in delivering the ball from a sand bunker and will help to shorten the run on shots from the fairway to the putting green.

Figure 6:
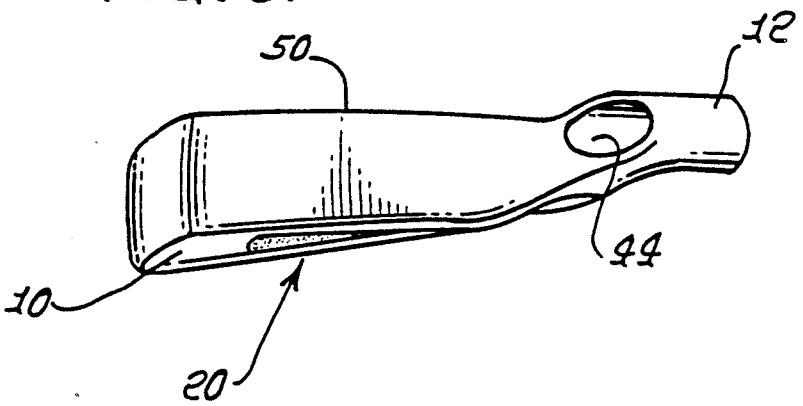
FIG. 6 is a bottom view.
Figure 11:
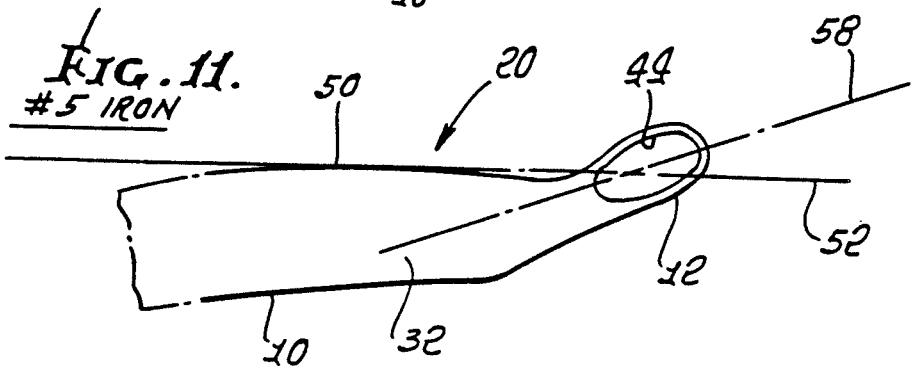
Figure 12:
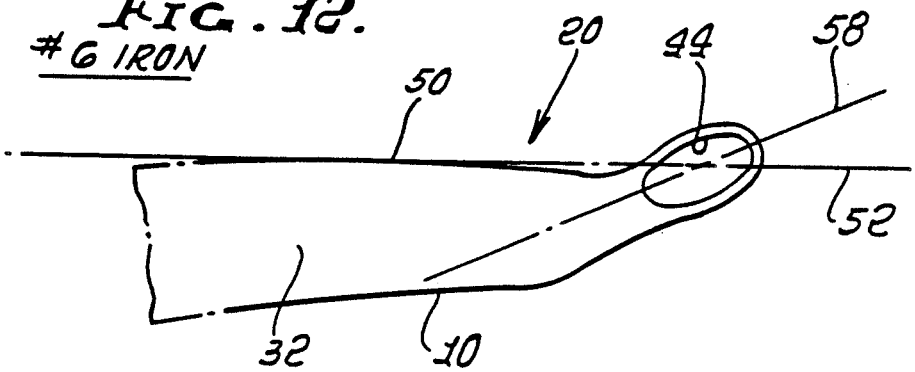
Figure 13:
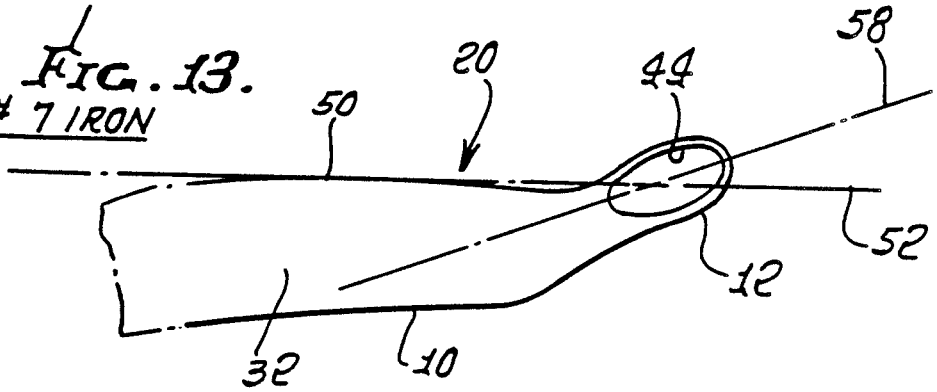
Figure 14:
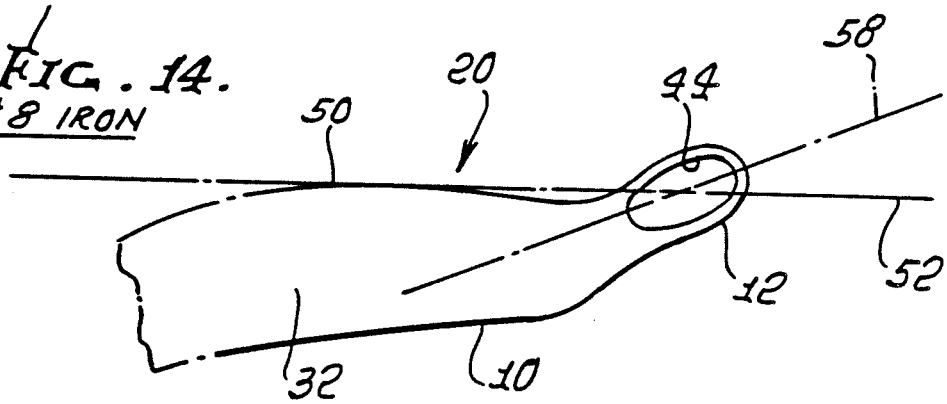
Figure 15:
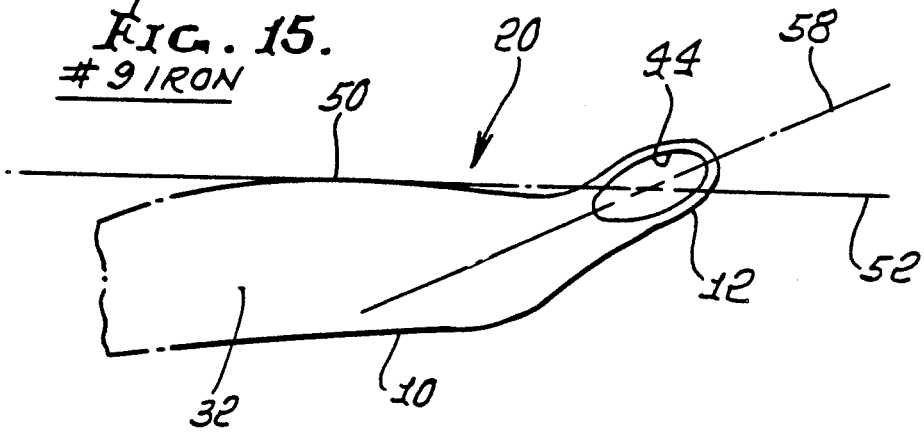
Figure 16:
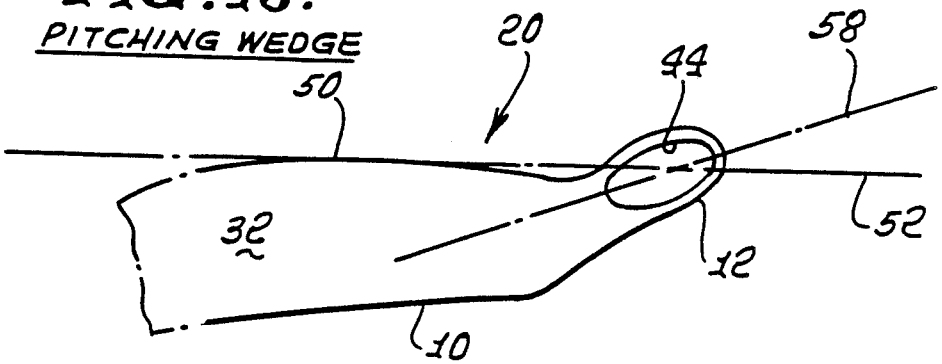
Figure 17:
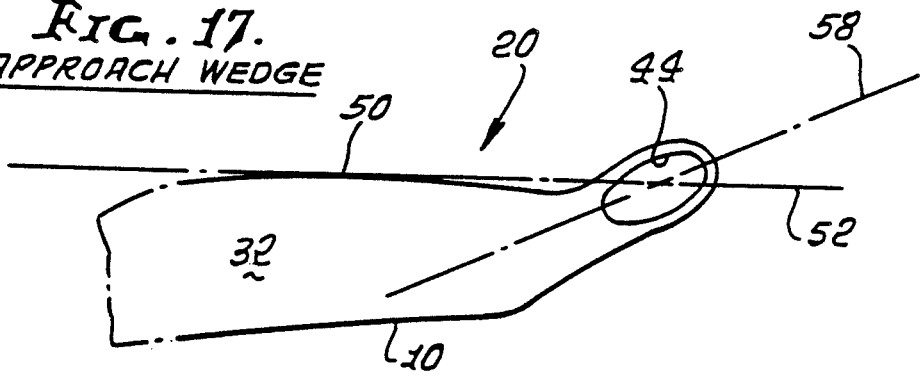
Figure 18:
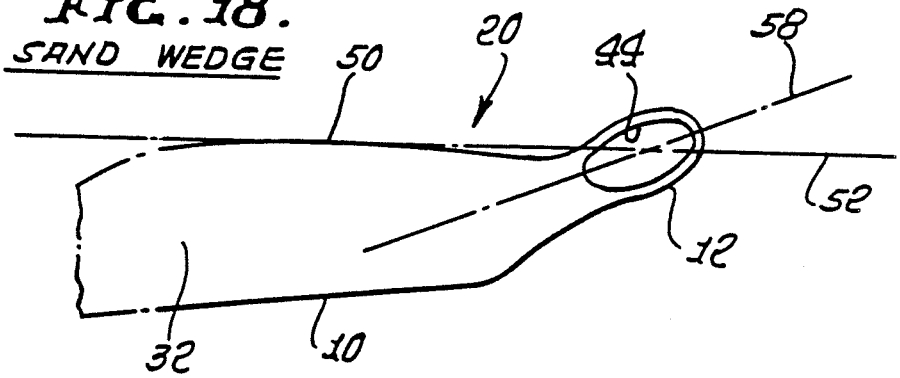
Figure 19:
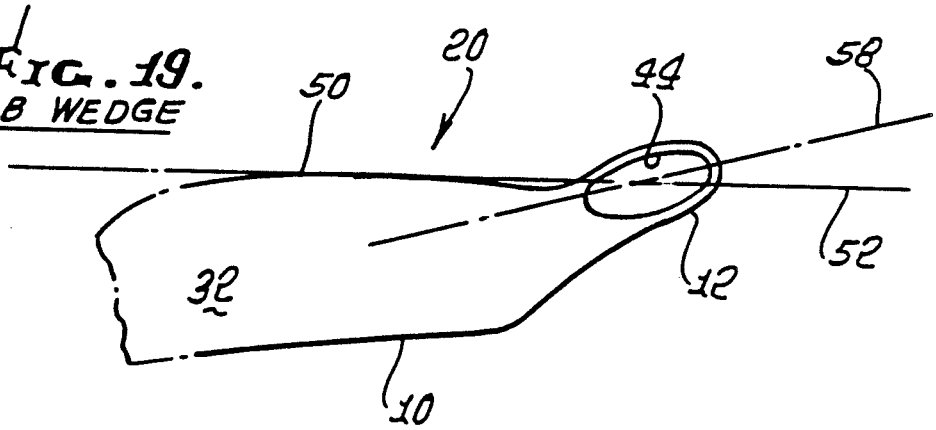

A unique and distinctive feature affecting the playing characteristics of our new club heads 20 is seen in FIGS. 7 to 19 which, as labeled, are, respectively, views of #1, #2, #3, #4, #5, #6, #7, #8, and #9 irons, a pitching wedge, an approach wedge, a sand wedge, and a lob wedge. FIG. *6a* and FIG. 11 are identical. The difference between the bottom view of FIG. 6 and the showings of FIGS. *6a* and FIGS. 7–19 is that the latter are developmental views taken from below as if the plane of the paper were wrapped about the soles 32 of the club heads 20. These sole developmental views are particularly apt in illustrating the feature of the invention that in sole or bottom views the lower ends of hosels 12 are seen to extend at obtuse angles forwardly from the heel ends of blades 10 in the manner of a dog-leg. As indicated by comparing FIGS. 6 and *6a*, one above another, this feature is also seen in the bottom view of FIG. 6 wherein the lower end of the hosel 12 extends at an obtuse angle forwardly from sole 32 in the manner of a dog-leg, but the clearer illustration is thought to be the sole developmental view of FIG. *6a*.

In these sole developmental views, the left ends are trailed off in broken lines to indicate the indefiniteness of the border of the toe ends of the soles 32, the soles being considered as those portions of the club heads that may contact the turf, which is indefinite in that the amount of sole that contacts the turf may be shorter or longer.

Figure 2:
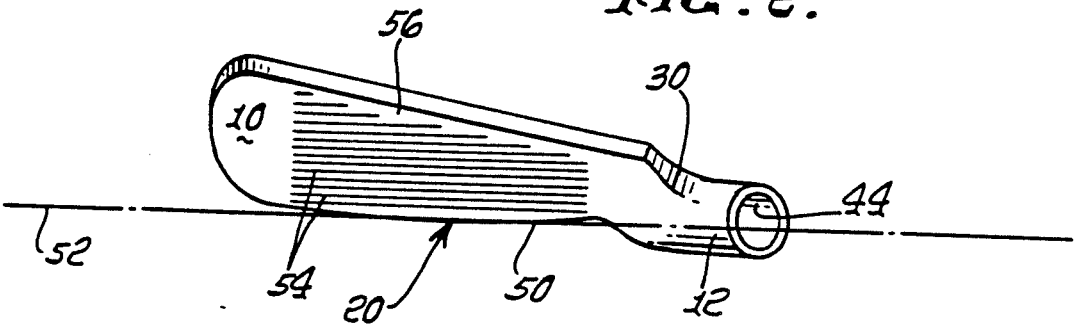
FIG. 2 is a top view.
Figure 3:
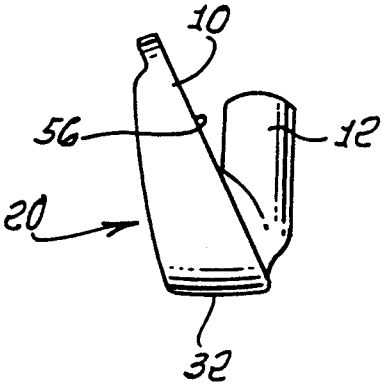
FIG. 3 is an elevational view from the toe end.
Figure 4:
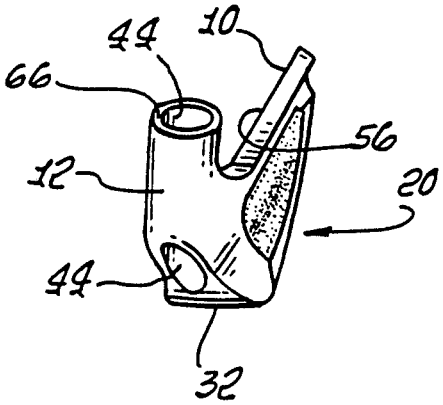
FIG. 4 is an elevational view from the heel end.
Figure 5:
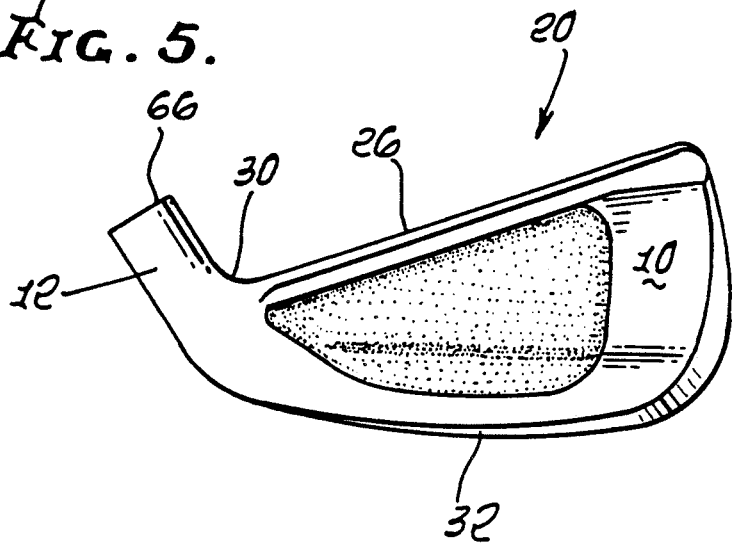
FIG. 5 is a rear view.
Figure 6A:
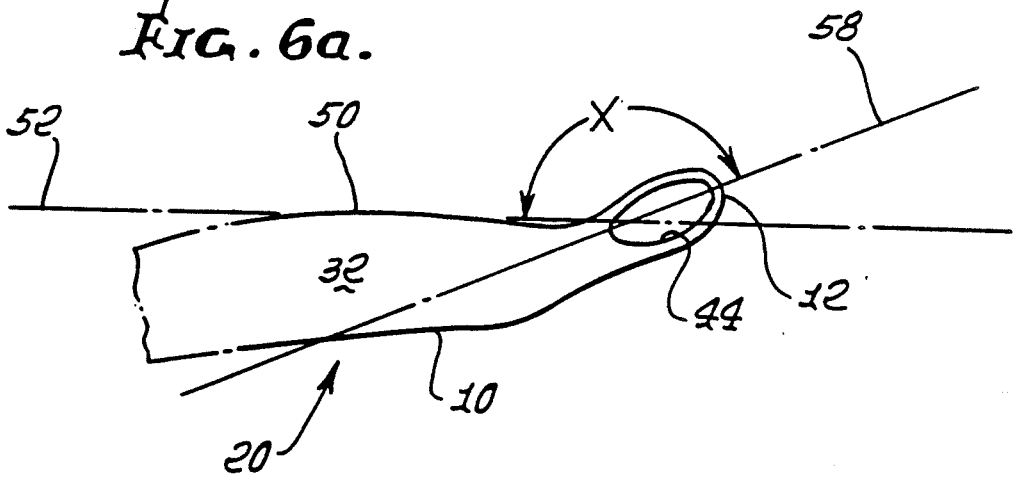
FIG. 6a is a developmental view of the sole of the club head, such as would be obtained if the paper were wrapped along the club head sole and the outline were drawn in that condition. Lines 6a–6a in FIG. 1 further indicate the way the view was taken.
Figure 7:
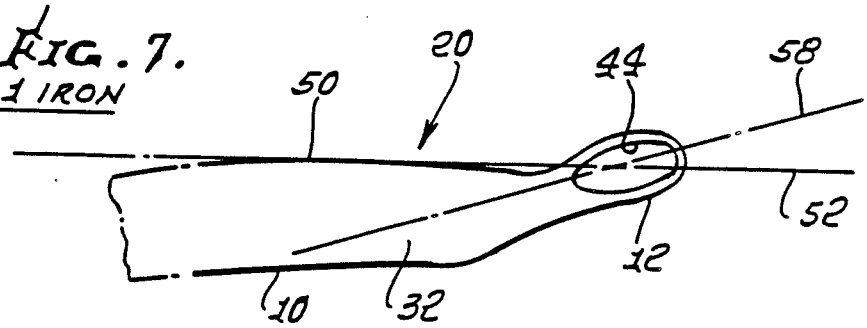
Figure 8:
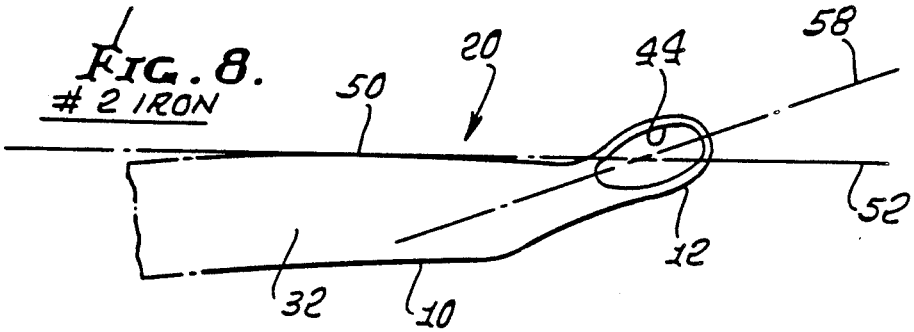
Figure 9:
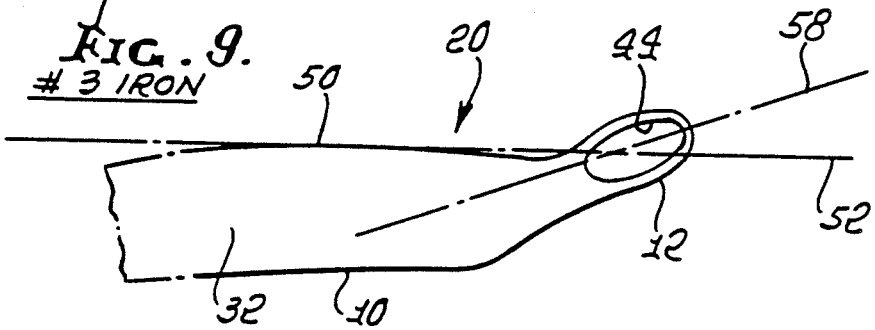
Figure 10:
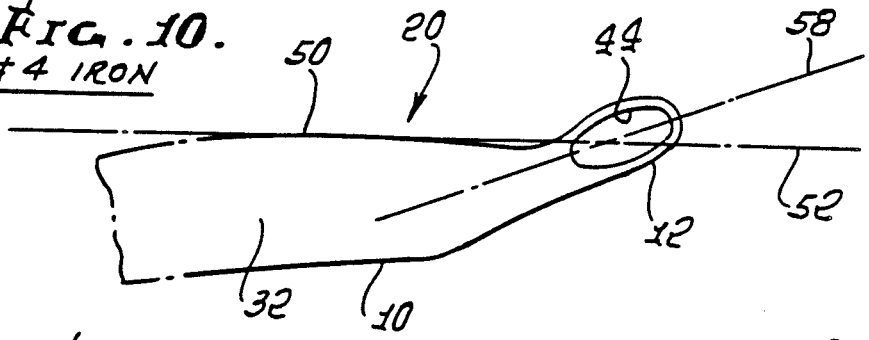

The forward edges 50 of blades 10 in sole or bottom view are slightly conversely curved. Broken lines 52 are tangential to the curved forward edge 50 in a forward direction, i.e., parallel to the grooves 54 on the face 56 of the club head. The grooves are hidden in sole and bottom views but are seen in FIGS. 1 and 2. It will be observed that line 52 runs centrally through the outline of bore 44, which is indicative of the degree of the angle and extent hosel 12 extends from blade 10 in the dog-leg. The major axis 58 of the outline of bore 44 is shown approximately in FIGS. 7–19. The angles between axes 58 and lines 52 measure approximately about 155–165 degrees in the drawings. Preferred limits are 150–170 degrees. This angle is shown as "x" in FIG. 6*a*.

To our knowledge, the relationships just described are unique to our set of irons and wedges. These and the other described unique features have resulted in a set of irons and wedges that have been judged improved in playability in various respects including power and efficiency, i.e., greater distance, higher trajectory, positive club head feel, better sense of control, and greater confidence. We also have considered good appearance to be important in the design.

FIGS. 20–24 show a modified form of the invention. However, the structure of FIGS. 20–24 is largely similar to the structure of FIGS. 1–19 and FIGS. 20–24 are similarly numbered as to blade 10', hosel 12', shaft portion 14' of shaft 16' secured in bore 44', club head 20', bridge 30', hickory outer tube 40', steel inner tube 42', sleeve 46', plastic plug 48', grooves 54', and face 56'.

Much of the purpose of our invention has been to reduce the size and weight of the hosel and to redistribute the saved weight into the blade. The club head 20 of FIGS. 20–24 is a Number 5 iron but the novel feature in this club head can be incorporated into the rest of the irons and wedges of a complete set. What is accomplished in the club head 20' is to remove an additional portion of hosel 12' and to add that weight to blade 10'. If FIGS. 1 and 20 are compared, it will be seen that hosel 12 in FIG. 1 has a variable length, longer at its line of joinder to blade 10 and shorter at the opposite heel end 60 of hosel 12, whereas in FIG. 20 the length (labeled dimension "y") of hosel 12' is the same all around (about $\frac{7}{8}$" or 29/32") roughly corresponds to the length of the hosel in FIG. 1 at the heel end 60. Measurement of the effective length of the wall of hosel 12 at the heel end 60 is somewhat inexact because the lower edge of hosel 12 is ground to fair into the curved plane of the remainder of sole 32'.

This is a logical improvement because if there is sufficient metal at the end 60 of hosel 12 in FIG. 1 then the longer hosel areas in FIG. 1 from end 60 to blade 10 are superfluous. The sole end of hosel 12' is substantially squared with the longitudinal axis 62 common to hosel 12', bore 44' and shaft 16'. This forms a step 64 in sole 32' below hosel 12'. In effect, the removed metal in the area of step 64 is redistributed to areas of blade 10', in the same manner as the weight saved by short hosel 12, 12' is redistributed to areas of blade 10, 10', with like purpose and effect. The lower end of hosel 12' would not have to be exactly at 90 degrees to axis 62, but, on the other hand, no purpose would be served in having the lower end of hosel 12' at any angle other than ninety degrees. Note the neck 70 at the plane 22' of merger of hosel 12' and blade 10' has a minimum vertical dimension in face view no greater than $\frac{3}{8}$". Even a larger necked area, i.e., $\frac{5}{8}$" minimum, would be a dramatic change from the prior art. The area of minimum dimension (labeled dimension "z" in FIG. 20) is indicated by line 72 indicating a plane in the face view of FIG. 20. The location of plane 72 will vary somewhat depending on how radiusing 30' is contoured.

In both forms of the invention (FIGS. 1–19 and FIGS. 20–24), the Portion 14,14' of the shaft 16,16' is fixedly secured in bore 44, 44' by bonding and also possibly by minor wedging, so that shaft portion 14, 14' is inflexible relative to hosel 12, 12'. Except for any minor tapering for wedging of shaft 16, 16', hosel 12, 12' has a bore 44, 44', of substantially constant diameter extending from the top of hosel 12, 12' down through sole 32, 32'. Hosel 12, 12' is solid and inflexible and has a substantially even wall thickness from a point in its lower portion to its top edge 66 which is substantially squared at 90 degrees to longitudinal axis 62 of hosel 12, 12'.

Having thus described our invention, we do not wish to be understood as limiting ourselves for the exact construction shown and described. Instead, we wish to cover those modifications of our invention that will occur to those skilled in the art upon learning of our invention and which are within the proper scope thereof.

We claim:

1. The improvement in an iron golf club, comprising:

(a) an iron golf club head having a sole and having a blade with a toe end and a heel end and having a face with a series of parallel grooves, (b) said head having a hosel disposed at said heel end of said blade in a position juxtaposed to said blade and formed from the same continuous piece of metal as an integral part lapping said heel end from the upper edge of said heel end downwardly and there being no bridge between said blade and said hosel below said hosel, said hosel extending from a level above the top of said blade down to said sole, said hosel having a through bore of substantially constant diameter extending from the top of said hosel down through said sole, said hosel being solid and inflexible and having a substantially even wall thickness from its lower portion to its top edge which is substantially squared relative to the axis of said bore, (c) said hosel, having a dog-leg which, in developmental view of said sole taken from below, extends at an obtuse angle forwardly from said heel end of said blade at an angle of 150–170 degrees between a line parallel to said grooves and the major axis of said bore as seen in said developmental view, (d) the lowermost sole end of said hosel being substantially squared with the longitudinal axis of said hosel forming a step substantially above the plane containing the sole of the club head below said lowermost portion of said hosel thereby reducing the weight of metal of said hosel which can be redistributed to said blade, and said club head having a necked area near the plane of merger of said hosel and said blade having no greater than a 5/8 inch vertical dimension in face view of said club head, and (e) a golf club shaft having a lower portion thereof fixedly secured within said bore; said lower portion of said shaft being inflexible relative to said hosel and extending completely to said lowermost end of said hosel.

2. The club described in claim 1 in which said angle is between 155 and 165 degrees and in which said minimum dimension is 3/8 inch.

3. The improvement in an iron golf club, comprising:

(a) an iron golf club head having a sole and having a blade with a toe end and a heel end, (b) said head having a hosel disposed at said heel end of said blade in a position juxtaposed to said blade and formed from the same continuous piece of metal as an integral part lapping said heel end from the upper edge of said heel end downwardly, and there being no bridge between said blade and said hosel below said hosel, said hosel extending from a level above the top of said blade down to said sole, said hosel having a through bore of substantially constant diameter extending from the top of said hosel down through said sole, said hosel being solid and inflexible and having a substantially even wall thickness from its lower portion to its top edge, (c) said hosel having a dog-leg which in bottom view of said club head extends at an obtuse angle forwardly from said heel end of said blade, (d) the lowermost sole end of said hosel being substantially squared with the longitudinal axis of said hosel forming a step substantially above the plane containing the sole of the club below said lowermost portion of said hosel thereby reducing the weight of metal of said hosel which can be redistributed to said blade, and (e) a golf club shaft having a lower portion thereof fixedly secured within said bore; said lower portion of said shaft being inflexible relative to said hosel and extending completely to said lowermost end of said hosel.

4. The improvement in an iron golf club, comprising:

(a) an iron golf club head having a sole and having a blade with a toe end and a heel end, (b) said head having a hosel disposed at said heel end of said blade in a position juxtaposed to said blade and formed from the same continuous piece of metal as an integral part lapping said heel end from the upper edge of said heel end downwardly, and there being no bridge between said blade and said hosel below said hosel, said hosel extending from a level above the top of said blade down to said sole, said hosel having a through bore of substantially constant diameter extending from the top of said hosel down through said sole, said hosel being solid and inflexible and having a substantially even wall thickness from its lower portion to its top edge, (c) the lowermost sole end of said hosel being substantially squared with the longitudinal axis of said hosel forming a step substantially above the plane containing the sole of the club below said lowermost portion of said hosel thereby reducing the weight of metal of said hosel which can be redistributed to said blade, and said club head having a neck near the plane of merger of said hosel and said blade having no greater than a $\frac{5}{8}$ inch vertical minimum dimension in face view of said club head, and (d) a gold club shaft having a lower portion thereof fixedly secured within said bore; said lower portion on said shaft being inflexible relative to said hosel and extending completely to said lowermost end of said hosel.

5. The club described in claim 4, in which said minimum dimension is $\frac{3}{8}$ inch.

6. The improvement in an iron golf club, comprising:

(a) an iron golf club head having a sole and having a blade with a toe end and a heel end, (b) said head having a hosel disposed at said heel end of said blade in a position juxtaposed to said blade and formed from the same continuous piece of metal as an integral part lapping said heel end from the upper edge of said heel end downwardly and there being no bridge between said blade and said hosel below said hosel, said hosel extending from a level above the top of said blade down to said sole, said hosel having a through bore of substantially constant diameter extending from the top of said hosel down through said sole, said hosel being solid and inflexible and having a substantially even wall thickness from its lower portion to its top edge, (c) the lowermost sole end of said hosel being substantially squared with the longitudinal axis of said hosel forming a step substantially above the plane containing the sole of the club below said lowermost portion of said hosel thereby reducing the weight of metal of said hosel which can be redistributed to said blade, and (d) a golf club shaft having a lower portion thereof fixedly secured within said bore; said lower portion of said shaft being inflexible relative to said hosel and extending completely to said lowermost end of said hosel.

* * * * *